United States Patent [19]

Ikienoue et al.

[11] 4,152,160

[45] May 1, 1979

[54] THERMALLY DEVELOPABLE LIGHT-SENSITIVE MATERIAL WITH A BENZOIC ACID

[75] Inventors: Shinpei Ikienoue; Takao Masuda; Nobuyoshi Sekikawa, all of Asaka, Japan

[73] Assignee: Fuji Photo Film Co., Ltd., Minami-ashigara, Japan

[21] Appl. No.: 893,747

[22] Filed: Apr. 5, 1978

[30] Foreign Application Priority Data

Apr. 8, 1977 [JP] Japan ..... 52-40163

[51] Int. Cl.[2] ..... G03C 1/92; G03C 1/34; G03C 1/00; G03C 1/72

[52] U.S. Cl. ..... 96/89; 96/76 R; 96/88; 96/91 R; 96/109; 96/114.1

[58] Field of Search ..... 96/114.1, 88, 109, 89, 96/76 R, 91 R

[56] References Cited

U.S. PATENT DOCUMENTS

| | | | |
|---|---|---|---|
| 4,022,617 | 5/1977 | McGuckin | 96/114.1 |
| 4,076,534 | 2/1978 | Noguchi et al. | 96/114.1 |

OTHER PUBLICATIONS

"Photothermographic Materials", *Research Disclosure*, No. 11723, 1/74, pp. 20 & 21.

*Primary Examiner*—Richard L. Schilling

*Attorney, Agent, or Firm*—Sughrue, Rothwell, Mion, Zinn and Macpeak

[57] ABSTRACT

A thermally developable light-sensitive material with improved storage stability and a minimized thermal fog without an increase in both light discoloration and dark discoloration which comprises a support and having therein or in at least one layer thereon at least (a) an organic carboxylic acid silver salt comprising about 50 mol% or more of silver behenate, (b) a photocatalyst and (c) a reducing agent, and with the material containing (d) at least one compound (1) represented by the following general formula (I):

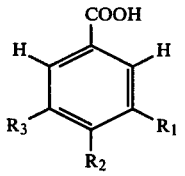

(I)

wherein $R_1$, $R_2$ and $R_3$, which may be the same or different, each represents a hydrogen atom or a substituent selected from the group consisting of a nitro group, a cyano group and a halogen atom, with the proviso that $R_1$, $R_2$ and $R_3$ are not all simultaneously a hydrogen atom, and (2) having a half-neutralization point of from about 40 mV to about 140 mV above the half-neutralization point of benzoic acid in isopropanol.

11 Claims, No Drawings

THERMALLY DEVELOPABLE LIGHT-SENSITIVE MATERIAL WITH A BENZOIC ACID

BACKGROUND OF THE INVENTION

1. Field of the Invention

The present invention relates to a thermally developable light-sensitive material, and more particularly, to a thermally developable light-sensitive material in which thermal fog (i.e., fog formed during thermal development) is minimized and freshness retention property (the capability of retaining, even after storage, the photographic characteristics initially possessed by the thermally developable light-sensitive material immediately after production, especially as to sensitivity) is improved without increasing both light discoloration (i.e., coloration occurring at the background of the light-sensitive material after development upon storage exposed to light) and dark discoloration (i.e., coloration due to heat and humidity in the background of the developed light-sensitive material on storage in the dark).

2. Description of the Prior Art

Silver halide photography has been employed most widely for a long time, because silver halide photography has superior photographic properties such as sensitivity and gradation to those of electrophotography or diazo photography.

Generally, a silver halide light-sensitive material for use in silver halide photography is imagewise exposed to light followed by development with a developing solution and subsequently is subjected to several wet processings such as stopping, fixing, washing or stabilizing so that the thus-obtained image does not rapidly discolor nor fade under normal room illumination and so that the undeveloped white portion (background) is not blackened.

Accordingly, many problems arise with silver halide photography, for example, the processings take a long time and are laborsome, handling of the chemicals is hazardous, staining of clothing and the processing room occur and, still further, pollution problems arise when the used processing solution is discharged.

As a result, a high-sensitivity silver halide photographic light-sensitive material suitable for dry processing which can be subjected to processing without the necessity for wet processing and which provides a stable image and further has minimized discoloration at the background under normal room illumination following the dry processing has been desired.

At the present, the most successful light-sensitive material, which can be used to form a photographic image thereon by dry processing, is a thermally developable light-sensitive material containing a composition comprising, as essential components, a silver salt of an organic acid, a small amount of a photocatalyst such as silver halide and a reducing agent, as described in U.S. Pat. Nos. 3,152,904 and 3,457,075.

In this type of light-sensitive system, the photocatalyst such as silver halide remaining in the light-sensitive material after development is allowed to discolor without being stabilized against light, yet substantially the same result as that attained by stabilization is obtained. This is because the photocatalyst such as a silver halide is used in a minor proportion whereas a white or lightly colored organic silver salt is used in a major proportion and is sufficiently stable that darkening upon exposure to light hardly occurs. Accordingly, even if the photocatalyst such as a silver halide discolors due to light, since it is present in a minor amount, the background has a white or lightly colored appearance overall and, therefore, this slight discoloration hardly causes any difficulty.

This light-sensitive material is stable at room temperature. However, when the light-sensitive material is imagewise exposed followed by heating generally at a temperature of about 80° C. or higher, preferably at 100° C. or higher, the organic silver salt oxidizing agent and the reducing agent which are incorporated in the light-sensitive layer thereof undergo an oxidation-reduction reaction due to the catalytic activity of the photocatalyst such as exposed silver halide in proximity to the organic silver salt. As a result, the exposed portion of the light-sensitive layer rapidly blackens and a contrast with the unexposed portion (background) thereof occurs, which results in image formation.

As described above, the present invention is directed to an improvement in thermally developable light-sensitive materials and, particularly, has been accomplished by adding thereto, as a stabilizing agent, component (d) which gives rise to the effects as described hereinafter.

Incorporation of organic carboxylic acids such as phthalic acids, benzoic acids, and long chain-carboxylic acids, or sulfonic acids into a thermally developable light-sensitive material is described for example, in Japanese Patent Application (OPI) Nos. 97523/1973, 89720/1973, 10039/1974, *Research Disclosure,* p. 20 (11723), January, 1974, and Japanese Patent Application (OPI) No. 125016/1974. (The term "OPI" as used herein refers to a "published unexamined Japanese patent application".)

However, it was found that these acids do not provide any advantages in a thermally developable light-sensitive material which employs silver behenate as the primary organic silver salt component. For example, the use of phthalic acids such as phthalic acid and tetrachlorophthalic acid increases the light discoloration and increases the dark discoloration. In addition, it was found that benzoic acids such as benzoic acid, p-hydroxybenzoic acid, salicylic acid, p-t-butylbenzoic acid, p-methylbenzoic acid and anisic acid hardly have any activity as a thermal fog-preventing agent. Further, it became clear that tetrabromobenzoic acid and tetrachlorobenzoic acid also have such a weak thermal fog-preventing activity that these acids decrease the $D_{max}$. Still further, it became clear that p-toluene sulfonic acids and benzene sulfonic acids decrease the $D_{max}$ of the image and, in addition, increase the light discoloration and the dark discoloration.

In order to solve the numerous problems in the prior art as described above, various investigations have been made energetically and the present invention has been accomplished.

SUMMARY OF THE INVENTION

A first object of the present invention is to provide a thermal fog-preventing agent which decreases both light discoloration and dark discoloration and is suitable for use with a thermally developable light-sensitive material employing an organic silver salt comprising silver behenate as a primary component.

A second object of the present invention is to provide an agent which improves the freshness retention property without causing any adverse increase in both light discoloration and dark discoloration and additionally is suitable for a thermally developable light-sensitive material employing an organic silver salt comprising silver behenate as a primary component.

After detailed investigations of various kinds of organic carboxylic acids, it has now been found that the addition of a compound having both the formula and the property as set forth below particularly to a thermally developable light-sensitive material employing a silver salt of an organic carboxylic acid comprising silver behenate as primary components gives rise to advantageous effects.

That is, the above-described objects of the present invention are attained by incorporating at least one benzoic acid (component (d)) represented by the general formula (I) as set forth below and, in addition, having a half-neutralization point of from about 40 mV to about 140 mV above the half-neutralization point of benzoic acid in isopropanol, in a thermally developable light-sensitive material employing a silver salt of an organic carboxylic acid comprising silver behenate as a primary component.

The present invention provides a thermally developable light-sensitive material which comprises a support having therein or in one or more layers thereon at least (a) an organic carboxylic acid silver salt comprising about 50 mole% or more of silver behenate, (b) a photocatalyst, and (c) a reducing agent, and with the material containing (d) at least one compound (1) represented by the following general formula (I):

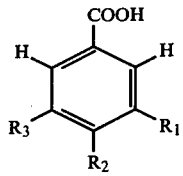

(I)

wherein $R_1$, $R_2$ and $R_3$, which may be the same or different, each represents a hydrogen atom or a substituent selected from the group consisting of a nitro group, a cyano group and a halogen atom (e.g., chlorine, bromine, iodine and fluorine), with the proviso that $R_1$, $R_2$ and $R_3$ are not all simultaneously hydrogen atoms, and (2) additionally having a half-neutralization point of from about 40 mV to about 140 mV above the half-neutralization point of benzoic acid in isopropanol.

DETAILED DESCRIPTION OF THE INVENTION

A method of measuring the half-neutralization point is described in I. Gyenes, et al., *Titration in Non-Aqueous Media,* Chapter 2, London Iliffe Books Ltd. (1967), and this method is employed herein in measurement of the half-neutralization point used in the present invention.

More specifically, prior to the determination of the half-neutralization point, a standard solution containing $5\times10^{-4}$ mole of benzoic acid dissolved in 50 ml of isopropanol is titrated with a titration solution prepared by diluting a 10% by weight methanol solution of n-tetrabutylammonium hydroxide with isopropanol to a concentration of 0.1 mol/l. The measured value of the half-neutralization point in the present invention is based on the electric potential of the standard solution obtained when half of the amount of the titration solution required for reaching an equivalence point has been added to the standard solution.

Generally, the measurement of the electric potential can be performed using a combination of a glass electrode, a suitable standard electrode (e.g., calomel electrode, silver chloride electrode, etc.) and a pH meter. Specifically, the measured values of the half-neutralization point as described in the specification of this application all are those obtained when a Type HGS-2005 glass electrode (manufactured by TOA DENPA Co., Ltd.), a double junction type silver electrode (manufactured by DENKI KAGAKU Co., Ltd.) as a standard electrode and an HM-18B pH meter (manufactured by TOA DENPA Co., Ltd.) are used in combination.

The half-neutralization points of various types of benzoic acids in isopropanol are determined using the above-described procedure, and benzoic acids whose measured values range from an $HNP_{BA}+$ about 40 mV (the half-neutralization point of benzoic acid in isopropanol plus 40 mV) to an $HNP_{BA}+$ about 140 mV (the half-neutralization point of benzoic acid in isopropanol plus 140 mV) are suitable for use in the present invention as component (d).

The most preferred benzoic acids are those which are represented by the above-described general formula (I) and have a half-neutralization point of from 40 mV to 95 mV above the half-neutralization point of benzoic acid in isopropanol.

On the other hand, benzoic acids having a half-neutralization point which is too low only a weak thermal fog-preventing activity, whereas those benzoic acids having too high a half-neutralization point adversely increase both the light discoloration and the dark discoloration and, in addition, decrease the $D_{max}$. Accordingly, these benzoic acid compounds are not preferred.

The other important factor required for defining component (d) for use in this invention is the chemical structure of the benzoic acids. That is, benzoic acids which are unsubstituted at the 2- or 6-position thereof are particularly suitable for component (d) of the present invention. Introduction of a substituent into the 2- or 6-position thereof decreases the thermal fog-preventing activity of the benzoic acids.

Specific examples of benzoic acids which can be used particularly advantageously in the present invention include m-nitrobenzoic acid, p-nitrobenzoic acid, m-cyanobenzoic acid, m-bromobenzoic acid, p-bromobenzoic acid, 4-chloro-3-nitrobenzoic acid, 3,4-dichlorobenzoic acid, 3,5-dichlorobenzoic acid, m-chlorobenzoic acid, p-chlorobenzoic acid, m-fluorobenzoic acid, p-fluorobenzoic acid, etc. These compounds are well known in the art and are commercially available. The half-neutralization points for these benzoic acids are given in Example 1 hereinafter.

Component (d) can be incorporated in a layer adjacent a layer containing components (a) and (b) (i.e., a light-sensitive layer), or included in the support, a subbing layer and an outermost coating layer. However, in a most preferred embodiment, component (d) is incorporated into a light-sensitive layer. Component (d) used in the present invention can be incorporated in a desired layer in the form of a solution or as a dispersion in a suitable solvent (e.g., methanol, ethanol, acetate, methyl ethyl ketone, etc.), or alternatively in the form of a powder.

A suitable amount of component (d) which can be used ranges from about 0.0005 mol to about 3 mol, preferably from about 0.001 mol to about 0.15 mol, per mol of the organic silver salt (component (a)).

The effect obtained by the addition of component (d) to a thermally developable light-sensitive material is particularly surprising and unexpected, even ignoring how component (d) works to achieve the objects of the present invention.

The organic silver salt comprising silver behenate as a primary component which can be used as component (d) in the present invention is an organic silver salt containing about 50 mol% or more, preferably 70 mol% or more, silver behenate. A silver salt of a long chain carboxylic acid is preferred as an organic silver salt which can be used in combination with the silver behenate. More preferably, the organic silver salt component (a) comprises about 50 mol% or more silver behenate and less than about 50 mol% of a silver salt of a long chain carboxylic acid having 14 or more carbon atoms. Silver behenate grains and the other organic silver salt grains may be present as a mere mixture, or alternatively mixed grains of silver behenate and the other organic silver salt(s) may be formed.

Specific examples of organic silver salts other than silver behenate comprising component (a) of the present invention include the following compounds: silver palmitate, silver stearate, silver arachidinate, silver lignocerate, silver pentacosanoate, silver heptacosanoate, silver nonacosanoate, and the like.

Hereinafter, the terms "organic silver salt" and "component (a)" are intended to mean such containing at least about 50 mol% silver behenate, unless otherwise indicated.

Advantages are obtained when component (d) of the present invention is used in combination with an organic silver salt comprising about 50 mol% or higher silver behenate, in particular. On the other hand, where an organic silver salt comprising, for example, silver laurate as a primary component (e.g., greater than about 50 mol%) is used in place of component (a), component (d) used in the present invention causes an increase in the light discoloration and, additionally, a decrease in the $D_{max}$ of the image obtained to occur.

The amount of the organic silver salt component (a) which can be used ranges from about 0.1 g to about 4 g, preferably from about 0.2 g to about 2.5 g, of silver per square meter of the support. When the amount of the organic silver salt used is less than about 0.1 g/m$^2$, the density of the image obtained is too low, whereas when the amount of the organic silver salt exceeds about 4 g/m$^2$, the amount of silver used increases even though there is no change in the density of the image, which results in a high cost.

Various methods of preparing the organic silver salt component (a) are known, for example, as described in U.S. Pat. Nos. 3,457,075, 3,458,544, 3,700,458 and 3,839,049, British Pat. Nos. 1,405,867, 1,173,426 and 1,405,867 and Japanese Patent Application (OPI) No. 122,011/1976. These methods are summarized below.

More specifically, an organic silver salt can be prepared by mixing Solution (A) in which an organic silver salt-forming agent (e.g., long chain carboxylic acids and the salts thereof) is dissolved or dispersed in a suitable solvent (e.g., water, aliphatic hydrocarbons, esters, ketones, halogenated hydrocarbons, ethers, aromatic hydrocarbons, alcohols, oils, etc.) with Solution (B) in which a silver salt capable of forming an organic silver salt (e.g., silver nitrate, silver trifluoroacetate, silver tetrafluoroborate, silver perchlorate, etc.) is dissolved or dispersed in a suitable solvent (e.g., water, alcohols, amides, amines, aqueous ammonia, ketones, acetonitrile, dimethyl sulfoxide, aromatic hydrocarbons, pyridine, aliphatic hydrocarbons, etc.). A mixture of about 50 mol% or more of behenic acid and less than about 50 mol% of a long chain carboxylic acid with 14 or more carbon atoms may be used as the above-described long chain carboxylic acid. Specific non-limiting examples of these solvents include toluene, xylene, water, cyclohexane, cyclohexene, dodecene, pentane, hexane, heptane, butyl acetate, amyl acetate, pentyl acetate, tricresyl phosphate, castor oil, methyl alcohol, ethyl alcohol, propyl alcohol, butyl alcohol, acetone, dioxane, methyl ethyl ketone, methyl isobutyl ketone, methylene chloride, dibutyl phthalate, dimethylformamide, ammonia, acetonitrile and the like.

A suitable reaction temperature which can be used to produce the organic silver salt component (a) ranges from about −80° C. to about 100° C., preferably from about −20° C. to about 70° C. A suitable reaction time ranges from about 0.01 second to about 150 hours, preferably from about 0.1 second to about 72 hours. The reaction pressure can range from about $10^{-2}$ mm Hg to about 300 atmospheres, and preferably is at a pressure of 1 atmosphere. A concentration for each of Solution (A) or (B) is about $10^{-2}$% by weight to $10^{2}$% by weight, more generally, from about 1% by weight to about 50% by weight, whether the solution is a solution or a dispersion.

Application of ultrasonic waves can be employed in the preparation of the organic silver salt component (a), as described in British Pat. No. 1,408,123.

In order to modify the crystal shape and the grain size of the organic silver salt component (a) and/or the photographic characteristics thereof such as thermal stability, fastness to light, light sensitivity, fog and the like, polymers, metal-containing compounds and surface active agents may be present during preparation of the organic silver salt component (a). Polyvinyl butyrals as described in U.S. Pat. No. 3,700,458 and Japanese Patent Application (OPI) No. 57111/1977 can be employed as a polymer.

Examples of metals for the metal-containing compound described above which can be used include mercury, lead, chromium, cobalt, and rhodium as described in British Pat. No. 1,378,734, Japanese Patent Application (OPI) Nos. 22430/1976, 116024/1975 and 13442/1976 and, in addition, manganese, nickel, iron and cerium.

The amount of the surface active agent or the polymer used is each about 0.1 g to about 1,000 g, preferably about 1 g to about 500 g, per mol of the organic silver salt component (a). On the other hand, the preferred amount of the metal-containing compound which is used ranges from about $10^{-6}$ mol to about $10^{-1}$ mol per mol of the organic silver salt component (a) and from about $10^{-5}$ mol to about $10^{-2}$ mol per mol of silver halide, when used as a photocatalyst.

The grain size in the longitudinal direction of the thus-prepared organic silver salt ranges from about 2$\mu$ to about 0.001$\mu$, preferably from about 0.5$\mu$ to about 0.01$\mu$.

The photocatalyst component (b) used in this invention can be a light-sensitive silver halide and examples include silver chloride, silver bromide, silver iodide, silver chloroiodobromide, silver chlorobromide, silver iodochloride, silver iodobromide and a mixture thereof. The amount of the silver halide used ranges from about 0.001 mol to about 0.7 mol, preferably from about 0.01 mol to about 0.5 mol, per mol of the organic silver salt component (a).

The light-sensitive silver halide for use as the photocatalyst component (b) can be prepared using methods well known in the photographic art, such as a single jet process or a double jet process to produce a photographic emulsion of which a Lippmann emulsion, an emulsion prepared by an ammoniacal process, and an emulsion ripened in the presence of a thiocyanate salt or a thioether are representative. The light-sensitive silver halide as component (b) thus previously prepared is mixed with an oxidation-reduction composition comprising an organic silver salt component (a) and a reducing agent component (c) as described in U.S. Pat. No. 3,152,904. Various approaches can be used in order to provide sufficient contact between the silver halide as component (b) and an organic silver salt as component (a). One method comprises adding the silver halide to the oxidation-reduction composition in the presence of a surface active agent, as described in, for example, U.S. Pat. No. 3,761,273, Japanese Patent Applications (OPI) Nos. 32926/1975 and 32928/1975. Another method comprises mixing a silver halide prepared in the presence of a polymer with an organic silver salt, as described in U.S. Pat. Nos. 3,706,565, 3,706,564 and 3,713,833 and British Pat. No. 1,362,970. Another method comprises decomposing a silver halide emulsion with an enzyme and then mixing the decomposition product with an organic silver salt, as described in British Pat. No. 1,354,186. The silver halide used in the present invention as component (b) can also be prepared substantially at the same time the organic silver salt as component (a) is formed, as described in, for example, Japanese Patent Application (OPI) No. 17216/1975.

Still another method comprises incorporating a compound which is capable of forming a light-sensitive silver halide (as hereinafter described) in a solution or dispersion containing an organic silver salt previously prepared, or alternatively in a sheet material containing an organic silver salt with a part of the organic silver salt being converted into a light-sensitive silver halide. This method is called the "halidation process" and U.S. Pat. No. 3,457,075 discloses that the thus-prepared silver halide provides advantageous results due to the effective contact of the silver halide with the organic silver salt.

The term "a compound capable of forming a light-sensitive silver halide" as used herein means a compound which can react with an organic silver salt to form a light-sensitive silver halide. Whether a particular compound falls within this class of compounds, and can be utilized effectively, can be determined by the following simple routine test. A compound to be tested is mixed with an organic silver salt, and then, if desired, heated. After that, the product is evaluated using X-ray diffraction to determine whether a diffraction peak intrinsic to silver halide appears in the product. When the silver halide is produced using the halidation method, the composition of component (a) prior to the halidation is controlled such that component (a) after the halidation contains at least 50 mol% of silver behenate.

The silver halide used as component (b) can be produced under the following conditions. A suitable reaction temperature is within the range of from about −80° C. to about 100° C., preferably from about −20° C. to about 70° C. An appropriatereaction time ranges from about 0.01 second to about 150 hours, preferably about 0.1 second to about 72 hours. The reaction pressure can range from about $10^{-2}$ mm Hg to about 300 atmospheres, preferably a pressure of 1 atmosphere.

Inorganic halides, onium halides, halogenated hydrocarbons, N-halo compounds and other halogen-containing compounds can be utilized as the compound capable of forming a light-sensitive silver halide. Specific examples of these compounds are described in detail in Japanese Patent Application (OPI) No. 22431/1976, U.S. Pat. No. 3,457,075, Japanese Patent Application (OPI) Nos. 78316/1975, 115027/1975 and 9813/1976. Some specific examples of these compounds are illustrated below.

(1) Inorganic Halides:

For example, halides as represented by, for example, the following formula:

$$MX_n$$

wherein M represents a hydrogen atom, an ammonium group, or a metal atom; X represents a chlorine atom, a bromine atom, or an iodine atom; and n is 1 when M is a hydrogen atom or an ammonium group while n is the valence of the metal when M is a metal atom. Suitable metal atoms for M include lithium, sodium, potassium, cesium, magnesium, calcium, strontium, barium, zinc, cadmium, mercury, tin, antimony, chromium, manganese, iron, cobalt, nickel, rhodium, cerium and the like.

(2) Onium Halides:

For example, quaternary ammonium halides such as trimethylphenylammonium bromide, cetylethyldimethylammonium bromide, and trimethylbenzylammonium bromide; quaternary phosphonium halides such as tetraethylphosphonium bromide; and tertiary sulfonium halides such as trimethylsulfonium iodide.

(3) Halogenated Hydrocarbons:

For example, iodoform, bromoform, tetrabromomethane and 2-bromo-2-methylpropane.

(4) N-Halo Compounds:

For example, N-chlorosuccinimide, N-bromosuccinimide, N-bromophthalimide, N-bromoacetamide, N-iodosuccinimide, N-bromophthalazone, N-bromooxazoline, N-chlorophthalazone, N-bromoacetanilide, N,N-dibromobenzenesulfonamide, N-bromo-N-methylbenzenesulfonamide, 1,3-dibromo-4,4-dimethylhydantoin, N-bromourazole and the like.

(5) Other Halogen-Containing Compounds:

For example, triphenylmethyl chloride, triphenylmethyl bromide, 2-bromobutyric acid, 2-bromoethanol, dichlorobenzophenone, bromotriphenyl and the like.

In each of the methods as described above, two or more kinds of compounds capable of forming a silver halide can be used in combination. The amount of the compound capable of forming a silver halide which can be used ranges from about 0.001 mol to about 0.5 mol, preferably from about 0.01 mol to about 0.3 mol, per mol of the organic silver salt component (a). When the amount of the compound used is less than about 0.001 mol, the sensitivity obtained is low. On the other hand, when the amount of the compound is greater than about 0.5 mol, light discoloration (i.e., disadvantageous coloring which occurs in the background thereof when the processed light-sensitive material is allowed to stand under normal room illumination) increases.

The silver halide prepared in any of these methods and used as component (b) can be sensitized with, for example, a sulfur-containing compound, a gold compound, a platinum compound, a palladium compound, a silver compound, a tin compound or the like, or with a mixture of these compounds. Suitable chemical sensitization techniques which can be used are described in, for example, Japanese Patent Application (OPI) Nos. 41519/1976, 49023/1976, 69628/1976, 88216/1976, 120715/1976 and 4821/1977.

A similar improvement in photographic properties can be accomplished by employing a method which comprises the steps of forming a silver halide in the presence of a part of the binder, flocculating the silver halide by centrifuging, and then redispersing the separated silver halide into the remainder of the binder, i.e., a flocculation method well known in the gelatino-silver halide photographic emulsion art, as described in, for example, Japanese Patent Application (OPI) No. 35623/1977.

Still further, a silver halide which is formed by reacting an organic silver salt and a compound capable of producing silver halide can be sensitized with an amide compound or an imino compound which is present during the reaction, as described in Japanese Patent Application (OPI) No. 28416/1977 and U.S. Pat. No. 3,980,482.

Some types of spectral sensitizing dyes which are known to be effective for use in the spectral sensitization of a gelatino-silver halide photographic emulsion are also advantageous in spectrally sensitizing the thermally developable light-sensitive material of the present invention, and such dyes can be utilized for the spectral sensitization of component (b). Examples of these spectral sensitizing dyes include cyanine, merocyanine, rhodacyanine, complex (trinuclear or quadrinuclear) cyanine or merocyanine, holopolar cyanine, styryl, hemicyanine, oxonol, hemioxonol and xanthene dyes. More preferred cyanine dyes are those with a basic nucleus such as a thiazoline, oxazoline, pyrroline, pyridine, oxazole, thiazole, selenazole or imidazole nucleus. Cyanine dyes with an imino group or a carboxy group, in particular, are most preferred. The merocyanine dyes can contain an acidic nucleus such as thiohydantoin, rhodanine, oxazolidinedione, thiazolidinedione, barbituric acid, thiazolinone, malononitrile or pyrazolone nucleus, in addition to the above-described basic nucleus. Merocyanine dyes with an imino group or a carboxy group are particularly advantageous.

Examples of spectral sensitizing dyes which are particularly effective for use with the thermally developable light-sensitive material of the present invention include merocyanine dyes with a rhodanine, thiohydantoin, or 2-thio-2,4-oxazolidinedione nucleus or the like as described in U.S. Pat. No. 3,761,279, Japanese Patent Application (OPI) Nos. 105127/1975 and 104637/1975.

In addition, trinuclear merocyanine dyes as described in U.S. Pat. No. 3,719,495, sensitizing dyes primarily useful for silver iodide as described in Japanese Patent Application (OPI) No. 17719/1974, styrylquinoline type dyes as described in British Pat. No. 1,409,009, rhodacyanine dyes as described in U.S. Pat. No. 3,887,943, acidic dyes, e.g., 2',7'-dichlorofluorescein as described in Japanese Patent Application (OPI) Nos. 96717/1974 and 102328/1974 and British Pat. No. 1,417,382, merocyanine dyes as described in Japanese Patent Application (OPI) No. 156424/1975 and Japanese Patent Application (OPI) No. 27924/1976 can be also utilized in the present invention.

The amount of these dyes employed can range from about $10^{-4}$ mol to about 1 mol per mol of silver halide or per mol of the compound which is capable of forming a silver halide component (b).

Other photocatalysts can be also employed as component (b) in place of the silver halide. For example, a light-sensitive complex of silver with a dye as described in, for example, Japanese Patent Publication No. 25498/1974, Japanese Patent Application (OPI) No. 4728/1971 and U.S. Pat. No. 3,933,507 can be employed as a photocatalyst. In addition, a combination of a highly light-sensitive organic silver salt and a low light-sensitive organic silver salt can be also employed as an organic silver salt for this purpose. Further, a metal salt with a diazo-sulfonate or sulfinic acid salt as described in U.S. Pat. No. 3,152,904 can be also employed as a photocatalyst. Still further, a photoconductive material such as zinc oxide and titanium oxide can be used. When a high speed thermally developable light-sensitive material is desired, a silver halide is most preferred as the photocatalyst component (b).

Suitable reducing agents which can be used for component (c) are those which are capable of reducing the organic silver salt component (a) when heated in the presence of the exposed photocatalyst.

Suitable reducing agents which can be used as component (c) include mono- or bis-phenols, mono- or bis-naphthols, di- or poly-hydroxynaphthalenes, di- or polyhydroxybenzenes, hydroxymonoethers, ascorbic acids, 3-pyrazolidones, pyrazolines, pyrazolones, reducing saccharides, phenylenediamines, hydroxylamines, reductones, hydroxamic acids, hydrazides, amidoximes, N-hydroxyureas and the like. Specific examples of these compounds are described in U.S. Pat. Nos. 3,615,533, 3,679,426, 3,672,904, 3,751,252, 3,751,255, 3,782,949, 3,801,321, 3,794,488 and 3,893,863, Belgian Pat. No. 786,086, U.S. Pat. Nos. 3,770,448, 3,819,382, 3,773,512, 3,928,686, 3,839,048 and 3,887,378, Japanese Patent Application (OPI) Nos. 15541/1975, and 36143/1975, Japanese Patent Application (OPI) Nos. 36110/1975 and 116023/1975, and Japanese Patent Application (OPI) Nos. 32324/1976 and 51933/1976. Suitable reducing agents can be selected from these compounds depending upon the properties of the organic silver salt component (a) used in combination therewith.

Particularly preferred reducing agents are polyphenols, sulfonamidophenols and naphthols. Preferred examples of polyphenols are 2,4-dialkyl-substituted orthobisphenols, 2,6-dialkyl-substituted parabisphenols and a mixture of these compounds, with specific examples including 1,1-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3,5-di-t-butylphenyl)methane, 2,6-methylene-bis(2-hydroxy-3-t-butyl-5-methylphenyl)-4-methylphenol, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, 2,2-bis(4-hydroxy-3-methyl-5-t-butylphenyl)propane, 2,2-bis(4-hydroxy-3,5-di-t-butylphenyl)propane and the like.

Specific examples of preferred naphthols include 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane and 4,4'-dimethoxy-1,1'-dihydroxy-2,2'-binaphthyl.

Specific examples of preferred sulfonamidophenols include 4-benzenesulfonamidophenol, 2-benzenesulfonamidophenol and 2,6-dichloro-4-benzenesulfonamidophenol.

Where phenylenediamines are used as a reducing agent, a color image can be obtained by utilizing the phenylenediamines in combination with a phenol type or active methylene type color coupler as described in U.S. Pat. Nos. 3,531,286 and 3,764,328. Similarly a color image can be obtained in accordance with the method as described in U.S. Pat. No. 3,761,270.

Most preferred of the above-described reducing agents are mono- and bis-phenols in which at least one of the two positions adjacent the position substituted with the hydroxy group is substituted with an alkyl group such as a methyl, ethyl, propyl, isopropyl and butyl group (e.g., a 2,6-di-t-butyl-phenyl group), because these compounds are advantageous in terms of the reduced light discoloration due to excellent fastness to light.

One method which can be used to determine whether a reducing agent is suitable comprises preparing a thermally developable light-sensitive material as set forth in the Examples given hereinafter and then examining the photographic properties obtained therefrom. Such can be easily accomplished by one skilled in the art.

The amount of the reducing agent which is used in the present invention can be varied depending upon the type of the reducing agent and/or the properties of the organic silver salt and other additives present in combination therewith. However, a suitable amount of the reducing agent used is, generally, from about 0.05 mol to about 10 mol, preferably from about 0.1 mol to about 3 mol, per mol of the organic silver salt component (a).

Two or more types of reducing agents as described above can be employed in combination, if desired.

The reducing agent used in the present invention is ordinarily incorporated in a light-sensitive layer, however, the reducing agent alternatively may be incorporated in the support or in an over-coating polymer layer, as hereinafter described, or in a subbing layer.

A variety of known compounds which prevent the formation of thermal fog in a thermally developable light-sensitive material can be used in the present invention. These compounds are described in U.S. Pat. No. 3,589,903, British Pat. Nos. 1,389,501 and 1,425,817, U.S. Pat. No. 3,957,493, Japanese Patent Application (OPI) No. 22431/1976, U.S. Pat. No. 3,885,968, Japanese Patent Application (OPI) Nos. 101019/1975, 116024/1975, 123331/1975, 134421/1975, 47419/1976, 42529/1976, 51323/1976, 57435/1976, 78227/1976 and 10433/1976, Japanese Patent Application (OPI) Nos. 24520/1977 and 32015/1978.

In a preferred embodiment of the present invention, component (d) used in the present invention is employed in combination with a thermal fog-preventing agent as described above, particularly, thiosulfonic acids, as a component (e).

Suitable thiosulfonic acids which can be used as component (e) are represented by the following general formula (II):

$$RSO_2SM_1 \qquad (II)$$

wherein R represents (1) a substituted or unsubstituted alkyl group or (2) a substituted or unsubstituted aryl group, and $M_1$ represents a cation other than a hydrogen ion. Preferably, R is an alkyl group having 22 or less carbon atoms, an alkyl group substituted with one or more of an alkoxy group having 1 to 8 carbon atoms or an aryl group having 6 to 18 carbon atoms, an aryl group having 6 to 30 carbon atoms, or a substituted aryl group substituted with one or more of an alkyl roup having 1 to 8 carbon atoms, an alkaryl group having 7 to 14 carbon atoms or an aryl group having 6 to 18 carbon atoms.

Specific examples of these thiosulfonic acids include sodium n-octylthiosulfonate, potassium n-dodecylthiosulfonate, potassium n-dodecanethiosulfonate, sodium benzylthiosulfonate, sodium n-undecanethiosulfonate, potassium n-tetradecanethiosulfonate, lithium benzylthiosulfonate, potassium n-hexadecanethiosulfonate, potassium 2-ethoxyethylthiosulfonate, sodium benzenethiosulfonate, lithium benzenethiosulfonate, potassium benzenethiosulfonate, sodium p-toluenethiosulfonate, potassium p-methoxybenzenethiosulfonate, potassium p-ethoxybenzenethiosulfonate, sodium 2-naphthylthiosulfonate, potassium 3-t-butylbenzenethiosulfonate, sodium 3,4-dimethylbenzenethiosulfonate, potassium 3-chlorobenzenethiosulfonate, sodium 4-nitrobenzenethiosulfonate, potassium 3-acetylbenzenethiosulfonate and the like. Two or more of these thiosulfonic acids can be employed in combination, if desired.

A suitable amount of the thiosulfonic acids which can be used preferably ranges from about $10^{-5}$ mol to about 1 mol, more preferably from $6 \times 10^{-4}$ mol to $10^{-1}$ mol, per mol of the organic silver salt component (a). When this amount is lower than about $10^{-5}$ mol, the thermal fog prevention effect is insufficient and when the amount exceeds about 1 mol, a disadvantage arises because the progress of development is hindered which results in a reduced maximum density being obtained.

These thiosulfonic acids can be added to any of the layers of the thermally developable light-sensitive material or to a support thereof. However, it is most preferred for the thiosulfonic acids to be incorporated in the layer to which component (d) is added.

A toning agent can be incorporated in at least one layer of the thermally developable light-sensitive material of the present invention. A toning agent is preferably used when a dark color, particularly black, image is desired.

The amount of a toning agent which can be used is about 0.0001 mol to about 2 mol, preferably from about 0.0005 mol to about 1 mol, per mol of the organic silver salt component (a). An effective toning agent can be selected and utilized depending upon the types of both the organic silver salt component (a) and the reducing agent component (c) used in combination therewith.

Phthalazinones, oxazinediones, cyclic imides, urazoles, 2-pyrazoline-5-ones and the like are employed as a suitable toning agent. Specific examples of these toning agents are described in detail in U.S. Pat. Nos. 3,846,136, 3,782,941, 3,844,797, 3,832,186, 3,881,938, and 3,885,967, British Pat. No. 1,380,795, Japanese Patent Application (OPI) Nos. 151138/1975, 91215/1974, 67132/1975, 67641/1975, 114217/1975, 32927/1975, and 22431/1976, and Japanese Patent Application No. 16128/1976. Accordingly, the toning agent to be used can be determined by reference to these patent specifications. Phthalazinone, N-acetylphthalazinone, N-hydroxyethylphthalazinone, phthalimide, N-hydroxyphthalimide, benzoxazinedione, uracil and the like are representative examples of toning agents which are suitable.

Two or more types of these toning agents can be used in combination as described in Japanese Patent Application (OPI) No. 1020/1978, if desired.

In order to prevent light discoloration which arises after the thermally developable light-sensitive material of the present invention has been processed (i.e., the phenomenon whereby a discoloration in the unexposed areas of the thermally developable light-sensitive material gradually increases upon exposure to ambient light after processing), precursors of stabilizing agents such as azolethioethers and blocked azolethiones as described in U.S. Pat. No. 3,839,041; tetrazolylthio compounds or precursors thereof as described in U.S. Pat. No. 3,700,457 and Japanese Patent Application (OPI) No. 50725/1976; halogen-containing compounds as described in U.S. Pat. Nos. 3,707,377, 3,874,946 and 3,955,982; 1-carbamoyl-2-tetrazoline-5-thiones as described in U.S. Pat. No. 3,893,859; elemental sulfur as described in Japanese Patent Application (OPI) No. b 26019/1976; and halogenated paraffins as described in Japanese Patent Application (OPI) No. 34714/1976 can be used. These compounds may be employed in combination, if desired. A particularly preferred example of these combinations is a combination of a blocked thione compound and a halogen-containing compound as described in U.S. Pat. No. 3,877,940.

Each of the components which are used in the present invention are preferably dispersed in at least one type of colloid as a binder. Suitable binders which are generally used are hydrophobic materials, however, hydrophilic materials can be also utilized. These binders are preferably transparent or semitransparent and further colorless, white or light colored. Specific examples of these binders include natural materials, e.g., proteins such as gelatin; cellulose derivatives; polysaccharides such as dextran; gum arabic and the like; and synthetic polymers. Preferred binders are described in Japanese Patent Application (OPI) Nos. 22431/1976, 12640/1975, 29126/1976, 19525/1976 and 84443/1974. Particularly preferred examples of binders include polyvinyl butyral, polyvinyl acetate, ethyl cellulose, vinylidene chloride/vinyl chloride type copolymers, polymethyl methacrylate, vinyl chloride/vinyl acetate copolymers, cellulose acetate butyrate, gelatin and polyvinyl alcohol. If desired, two or more binders can be used in combination. The ratio by weight of the binder to an organic silver salt component (a) is from about 1:10 to about 10:1, preferably from about 1:4 to about 4:1.

At least one layer which contains all of the components used in the thermally developable light-sensitive material of the present invention and the other layer(s) are coated on various kinds of the supports which can be selected from a variety of materials. Generally, any form of support can be used. However, a film-, sheet-, roll-, or ribbon-support is conventionally used, and a flexible support is preferred from the standpoint of handling of the thermally developable light-sensitive material utilized as an information-recording material. Examples of materials for the support include a synthetic resin film, a synthetic resin sheet, glass, wool cloth, cotton cloth, paper and metals such as aluminum and the like. Examples of suitable synthetic resin films include a cellulose acetate film, a polyester film, a polyethylene terephthalate film, a polyamide film, a polyimide film, a triacetate film, a polycarbonate film and the like. In addition, examples of suitable paper supports include conventional papers and further a photographic base paper, a graphic art paper such as a coated paper and an art paper, a baryta paper, a resin-coated paper, a water-proof paper, a paper sized with a polysaccharide or the like as described in Belgian Pat. No. 784,615, a paper containing a pigment such as titanium dioxide or the like, a paper coated with an $\alpha$-olefin polymer (e.g., polyethylene, polypropylene, ethylene-butene copolymers, etc.), a paper previously processed with polyvinyl alcohol and the like.

A vacuum evaporated metal layer as described in U.S. Pat. No. 3,748,137, a back layer as described in Japanese Patent Application (OPI) No. 43130/1976, Japanese Patent Application (OPI) No. 129220/1976 and Japanese Patent Application (OPI) No. 52818/1976, and a back layer containing a magnetizable material as described in Japanese Patent Application (OPI) No. 136099/1975 can be applied to the thermally developable light-sensitive material.

In addition, if desired, an over-coating polymer layer can be applied onto a thermally developable light-sensitive layer in order to increase the transparency of the light-sensitive layer and, moreover, to improve both the moisture resistance and the heat resistance thereof, as described in U.S. Pat. Nos. 3,933,508, 3,856,526, 3,856,527 and 3,893,860.

A suitable thickness of the over-coating polymer layer ranges from about 1$\mu$ to about 20$\mu$. Illustrative examples of polymers suitable for use as the over-coating polymer layer are polyvinyl chloride, polyvinyl acetate, vinyl chloride-vinyl acetate copolymers, polystyrene, methyl cellulose, ethyl cellulose, cellulose acetate butyrate, vinylidene chloride-vinyl chloride copolymers, cellulose acetate, polyvinylidene chloride, polycarbonate, gelatin and polyvinyl alcohol.

A matting agent such as titanium dioxide, kaolin, zinc oxide, silicon dioxide, alumina and starch can be added to the over-coating polymer layer as described in, for example, Belgian Pat. No. 798,367, Japanese Patent Application (OPI) Nos. 87318/1975, 128726/1974 and 46316/1975 and Japanese Patent Application (OPI) No. 33615/1978, so as to enable the material to be written on with stamp ink, a ball-point pen or a pencil, or alternatively a light-absorbing agent can be added as a filter for light having a specific wavelength or an imino compound can be added to improve the photographic properties of the thermally developable light-sensitive layer.

A subbing layer as described in Japanese Patent Application (OPI) No. 87,721/1978 can be positioned between the light-sensitive layer of the present invention and a support therefor.

If desired, the thermally developable light-sensitive material can contain a halation-preventing material and/or a halation-preventing dye. Use of a material which is easily decolored by heat and/or light as described in, for example, U.S. Pat. Nos. 3,769,019, 3,745,009 and 3,821,001 and Japanese Patent Publication No. 43321/1974 is preferred for this purpose.

If desired, the thermally developable light-sensitive material of the present invention can contain a variety of additives heretofore known and conventionally employed in the art of gelatino-silver halide light-sensitive materials, such as light-absorbing materials, fluorescent whitening agents, plasticizers, lubricating agents, surface active agents and hardening agents.

In addition, if desired, the thermally developable light-sensitive material of the present invention can contain a matting agent such as calcium carbonate, starch, titanium dioxide, zinc oxide, silica, dextrin, barium sulfate, aluminum oxide, clay, diatomaceous earth and kaolin.

Further, if desired, the thermally developable light-sensitive material of the present invention can contain a leuco dye as described in Japanese Patent Application (OPI) No. 62025/1975, an acid as described in U.S. Pat. No. 3,645,739, and Japanese Patent Application (OPI)

Nos. 125016/1974 and 57619/1975, and a stabilizing agent such as a sulfur-containing compound as described in Japanese Patent Application (OPI) Nos. 26020/1976, 78319/1976 and 81124/1976. Further, the thermally developable light-sensitive material of the present invention can contain a development-accelerating agent or a sensitizing agent with examples including materials capable of melting at high temperatures and functioning as a solvent, oniom halides, zinc, cadmium or copper salts, polyalkylene glycols, metal iodides other than silver iodide, alkali-generating agents, thiouracyls, benzotriazoles and mercaptotetrazoles, as described in U.S. Pat. Nos. 3,667,959, 3,679,422, 3,708,304, 3,871,887, 3,666,477 and 3,635,719 and Japanese Patent Application (OPI) Nos. 3223/1976, 27923/1976 and 22625/1975. Still further, the thermally developable light-sensitive material of the present invention can contain poly(dimethylsiloxane) as described in U.S. Pat. No. 3,885,965 in order to prevent finger stains.

A method of producing a thermally developable light-sensitive material of the present invention is specifically summarized as follows. That is, an organic silver salt-forming agent and a silver ion-supplying agent such as silver nitrate are reacted using any of the various methods hereinbefore described to produce an organic silver salt. If desired, the thus-prepared organic silver salt is washed with water, an alcohol or the like. After that, the organic silver salt is dispersed into a binder for an emulsion using a colloid mill, a mixer, a ball mill or the like. Alternatively, the organic silver salt can be produced in the presence of the binder. To the resulting polymer dispersion containing the organic silver salt is added a silver halide-forming agent to convert a portion of the organic silver salt to silver halide. Alternatively, a silver halide previously prepared can be added to the polymer dispersion of the organic silver salt, or the organic silver salt and the silver halide can be prepared simultaneously. Next, a variety of additives such as a sensitizing dye, a reducing agent, a toning agent, and the like are added successively to the polymer dispersion preferably in the form of a solution thereof. The coating solution preparation is completed upon addition thereto of all of the additives in the manner as described above. Ordinarily, the coating solution is, in that condition, coated onto a suitable support without drying. An over-coating polymer layer, a subbing layer, a backing layer and other layers as well as the thermally developable light-sensitive layer formed through these procedures can be each formed by coating coating solutions previously prepared therefor onto the support using known coating methods such as dip coating, air knife coating, curtain coating and hopper coating. In addition, if desired, two or more layers can be simultaneously coated on the support, as described in U.S. Pat. No. 2,761,791 and British Pat. No. 837,095.

As a solvent which can be used in a coating solution, a non-inflammable solvent as described in British Pat. No. 1,422,145 can be utilized, but this is not to be construed as limiting.

If desired, the surface or the back of the support or a layer coated on the support can be printed, and a thermally developable light-sensitive material thus-printed with a pattern can be employed as a (season) ticket, a post card or other documents.

The thus-produced thermally developable light-sensitive material is cut to a size suitable for use and then is imagewise exposed. If desired, the thermally developable light-sensitive material can be subjected to the preliminary heating (e.g., to about 80° to 140° C.) prior to exposure. Illustrative examples of light sources suitable for the image-wise exposure are a tungsten lamp, a fluorescent lamp for copying primarily used for exposure of diazo light-sensitive materials, a mercury lamp, an iodine lamp, a xenon lamp, a CRT, a laser and the like. Suitable originals which can be used include not only a line image such as a drawing but also a photographic image having a continuous gradation. In addition, people and/or landscapes can be photographed using the thermally developable light-sensitive material in a camera. Examples of printing methods which can be employed include contact printing in contact with an original, reflection printing and enlargement printing.

Although the amount of exposure depends upon the sensitivity of the thermally developable light-sensitive material, generally a high sensitivity light-sensitive material requires about 10 lux second while a low sensitivity light-sensitive material requires about $10^4$ lux second for exposure.

The light-sensitive material thus imagewise exposed is developed merely by heating at a temperature of about 80° C. to about 180° C., preferably about 100° C. to about 150° C. The time of heating is optionally adjusted, for example, from about 1 second to about 60 seconds. The period of heating time which is suitable is determined in relation to the temperature of heating. A variety of heating means can be used including the following methods:

(1) the light-sensitive material can be contacted with a simple heated plate,
(2) the light-sensitive material can be contacted with a heated drum,
(3) the light-sensitive material can be passed through a heated space, and
(4) the light-sensitive material can be heated using high frequency heating and/or by applying a laser beam thereto.

In order to prevent an offensive odor from being generated on heating, a deodorant can be provided in a processing apparatus. In addition, in order to make the offensive odor from a light-sensitive material difficult to perceive, certain perfumes can be incorporated therein.

Various methods of stabilizing the light-sensitive material after processing against light and/or heat can be applied to the thus-processed light-sensitive material of the present invention. Examples of these methods include a stabilization method with a solution containing thiosulfates, thiocyanates, triphenyl phosphine, mercapto compounds or the like as described in U.S. Pat. No. 3,617,289, Japanese Patent Application (OPI) No. 104826/1976; a stabilization method with an aldehyde compound as described in Japanese Patent Application (OPI) No. 80226/1976; and a stabilization method which comprises applying a solution containing a stabilizing agent such as a mercapto compound and a halogen-containing compound to a light-sensitive material after, or prior to, or during, processing as described in Japanese Patent Application (OPI) Nos. 54329/1975, 77034/1975, 156425/1975, 328/1976 and 121332/1976.

The thermally developable light-sensitive material of the present invention can be employed for various end-uses. For example, the light-sensitive material can be used to record a direct positive image as described in U.S. Pat. Nos. 3,607,282 and 3,589,901; can be used as a lithographic printing plate as described in Japanese Patent Application (OPI) No. 4659/1974, and U.S. Pat.

Nos. 3,679,414 and 3,811,886; can be employed as a thermal transfer film as described in U.S. Pat. Nos. 3,767,394 and 3,859,094, and Japanese Patent Publication No. 13023/1976; and can be employed as a season ticket as described in Japanese Patent Application (OPI) Nos. 87318/1975 and 125737/1975, and Japanese Patent Publication No. 4107/1976. In addition, the heating apparatus of other photographic systems containing a heating step can be applied to the thermal development of this invention.

The thermally developable light-sensitive material of the present invention provides marked improvements in both thermal fog and a freshness-retention property without a deterioration in either light discoloration and dark discoloration.

The present invention will be further illustrated in greater detail by reference to the following Examples and Comparative Examples. Unless otherwise indicated herein, all parts, percents, ratios and the like are by weight.

EXAMPLE 1

Measurement of the half-neutralization point in isopropanol was carried out according to the method as described hereinbefore.

The relative values which were obtained assuming that the value of benzoic acid is 0 are shown in Table 1 below. The measurement was performed at room temperature (i.e., about 25° C.).

TABLE 1

| Substituent Group | Half-Neutralization Point (mV) |
|---|---|
| p-tert-Butyl | + 15 |
| p-Methoxy | − 5 |
| p-Octyloxy | − 3 |
| o-Bromo | + 75 |
| m-Bromo | + 50 |
| p-Bromo | + 40 |
| o-Hydroxy | + 140 |
| m-Hydroxy | − 5 |
| p-Hydroxy | − 45 |
| o-Nitro | + 125 |
| m-Nitro | + 90 |
| p-Nitro | + 100 |
| 4-Chloro-3-nitro | + 103 |
| 3,4-Dinitro | + 158 |
| 2,4-Dichloro | + 90 |
| 3,4-Dichloro | + 44 |
| 2,3,4,6-Tetrachloro | + 165 |

EXAMPLE 2

A mixture of 34 g of behenic acid and 500 ml of water was heated at 85° C. to dissolve the behenic acid. To the mixture of water and behenic acid dissolved therein at 85° C. with stirring at 1,800 rpm was added a sodium hydroxide aqueous solution (2.0 g of sodium hydroxide in 50 cc of water at 25° C.) over a period of 3 minutes so as to prepare a mixture of sodium behenate and behenic acid. After that, the temperature of the mixture was decreased from 85° C. to 30° C., while stirring at 1,800 rpm.

Next, to this mixture with stirring was added a silver nitrate aqueous solution (8.5 g of silver nitrate in 50 cc of water at 25° C.) over a period of 3 minutes and then the mixture was further stirred for 90 minutes. The silver behenate grains produced by adding 200 cc of isoamyl acetate to the reaction mixture were recovered and then dispersed in an isopropanol solution containing polyvinyl butyral (25 g of polyvinyl butyral in 200 cc of isopropanol) with a homogenizer to prepare a polymer dispersion containing silver behenate.

After that, to the polymer dispersion of silver behenate maintained at 50° C. and with stirring at 500 rpm was added an acetone solution of N-bromosuccinimide (7.0 g of N-bromosuccinimide in 50 cc of acetone at 25° C.) and subsequently the stirring was further continued for 60 minutes to prepare a polymer dispersion containing silver bromide and silver behenate.

One twelfth (1/240 mol) of the polymer dispersion containing silver bromide and silver behenate was weighed out. To this dispersion maintained at 30° C. and with stirring at 200 rpm were added the components as described below at five minute intervals to prepare Coating Solution (A).

| | |
|---|---|
| (i) Merocyanine Dye * (sensitizing dye) (0.025 weight % methyl Cellosolve solution) | 2 ml |
| (ii) Sodium Benzenethiosulfonate (0.02 weight % methanol solution) | 2 ml |
| (iii) Phthaladinone (4.5 weight % methyl Cellosolve solution) | 5 ml |
| (iv) m-Nitrobenzoic Acid (component (d) of the present invention) (0.5 weight % ethanol solution) | 2 ml |
| (v) o-Bisphenol ** (reducing agent) (10 weight % acetone solution) | 10 ml |

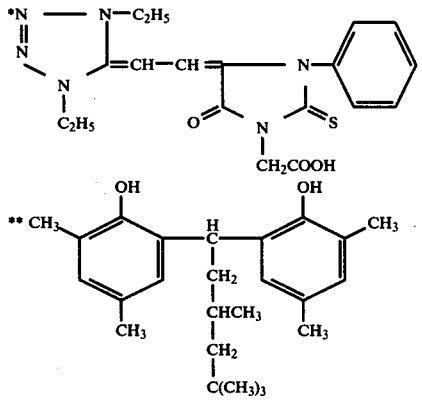

Separately, Coating Solution (B) for comparison was prepared in the same manner as for Coating Solution (A), except that (iv) the m-nitrobenzoic acid, as component (d), was not employed.

In addition, Coating Solution (C) for comparison was prepared in the same manner as for Coating Solution (A), except that (ii) sodium benzenethiosulfonate described above was not employed.

Additionally, Coating Solution (D) for comparison was prepared in the same manner as for Coating Solution (A), except that components (ii) and (iv) were both not used.

Thermally Developable Light-Sensitive Materials (A), (B), (C) and (D) were each prepared by applying the thus-obtained four types of Coating Solutions (A) to (D) to a support (i.e., a base paper for a pressure-sensitive copying paper, having coated thereon a subbing layer composed of polyvinyl alcohol) in a coating amount of 0.3 g of silver coated per square meter, respectively. The resulting Thermally Developable Light-Sensitive Materials (A), (B), (C) and (D) were each exposed to light from a tungsten lamp through a light wedge (the maximum amount of exposure to light was 3,000 CMS). Next, these light-sensitive materials were each thermally developed by contacting them with a heated plate at 130° C. for 8 seconds.

Additionally, Thermally Developable Light-Sensitive Materials (A), (B), (C) and (D) were each allowed to stand for 2 weeks under the conditions of 40% relative humidity (adjustment of humidity was carried out with glycerin) and 35° C. of temperature. This procedure is hereinafter referred to as forced deterioration testing.

After that, these thermally developable light-sensitive materials were each exposed to light and thermally developed under the above-described conditions.

The photographic properties were evaluated by measuring the reflection densities of these samples. The results which were obtained are shown in Table 2 below.

TABLE 2

| Sample No. | Prior to Forced Deterioration Fog | $D_{max}$ | Relative Sensitivity* | After Forced Deterioration Fog | $D_{max}$ | Relative Sensitivity* |
|---|---|---|---|---|---|---|
| (A) | 0.08 | 1.39 | 100 | 0.09 | 1.38 | 85 |
| (B) | 0.10 | 1.36 | 100 | 0.23 | 1.35 | 55 |
| (C) | 0.12 | 1.38 | 108 | 0.28 | 1.36 | 53 |
| (D) | 0.20 | 1.37 | 95 | 0.58 | 1.35 | — |

*Relative sensitivity assuming that the sensitivity of the Light-Sensitive Material (B) was 100. The sensitivity is based on the reciprocal of the exposure amount required for a density of 0.1 above the fog density.

The light discoloration test of the processed Light-Sensitive Materials (A), (B) and (C) was carried out using a diazo duplicator (COPYSTER-DART-1000, manufactured by Mita Industry Co., Ltd.). (Speed: 1, Passage: 10 times). The results which were obtained are shown in Table 3 below.

TABLE 3

| Sample No. | Light Discoloration* |
|---|---|
| (A) | 0.13 |
| (B) | 0.15 |
| (C) | 0.12 |

*The light discoloration was determined by the difference between the background density after the samples had been passed through the COPYSTER and the background density prior to the passage.

Sample (D) was not tested because of the high fog formation caused by the thermal development.

The results in Table 2 demonstrate that m-nitrobenzoic acid as component (d) decreased the thermal fog on the samples both prior to and after the forced deterioration.

In addition, the results demonstrate that a combination of m-nitrobenzoic acid, component (d), and sodium benzenethiosulfonate, component (e), according to the present invention further remarkably decreased the thermal fog.

Additionally, the results in Table 3 show that m-nitrobenzoic acid improved the light discoloration.

COMPARATIVE EXAMPLE 1

Thermally Developable Light-Sensitive Materials (E), (F), (G), (H) and (J) were prepared in the same manner as described in Example 1, except for the following. That is, o-hydroxybenzoic acid, m-hydroxybenzoic acid, o-nitrobenzoic acid, o-bromobenzoic acid, 2,3,4,6-tetrachlorobenzoic acid and benzoic acid were each employed in the amount as described in Table 4 below, in place of the m-nitrobenzoic acid (iv) used in Coating Solution (A) as set forth in Example 1.

The results which were obtained on testing these light-sensitive materials under the same conditions as those in Example 1 are also shown in Table 4 below. The solvent used for component (iv) in each instance was ethanol.

TABLE 4

| Sample No. | Component (iv) | Prior to Forced Deterioration Fog | $D_{max}$ | Relative Sensitivity | After Forced Deterioration Fog | $D_{max}$ | Relative Sensitivity |
|---|---|---|---|---|---|---|---|
| (E) | o-Hydroxybenzoic Acid 0.4% 2cc | 0.11 | 1.35 | 103 | 0.26 | 1.35 | 48 |
| (F) | m-Hydroxybenzoic Acid 0.4% 2cc | 0.10 | 1.35 | 100 | 0.25 | 1.33 | 53 |
| (G) | o-Nitrobenzoic Acid 0.5% 2cc | 0.09 | 1.35 | 95 | 0.16 | 1.32 | 68 |
| (H) | o-Bromobenzoic Acid 0.6% 2cc | 0.12 | 1.36 | 102 | 0.25 | 1.34 | 55 |
| (I) | Tetrachloro-benzoic Acid 0.8% 2cc | 0.09 | 1.08 | 86 | 0.18 | 0.85 | 38 |
| (J) | Benzoic Acid 0.35% 2cc | 0.11 | 1.35 | 100 | 0.22 | 1.35 | 55 |
| (B) | — | 0.10 | 1.36 | 100 | 0.23 | 1.35 | 55 |

It is apparent from the results set forth in Table 4 above that benzoic acids with a substituent at the 2-position thereof are not suitable for component (d) of the present invention.

COMPARATIVE EXAMPLE 2

Thermally Developable Light-Sensitive Materials (K) and (L) were prepared in the same manner as in Example 1, except for the following. That is, phthalic acid and tetrachlorophthalic acid anhydride were each employed in place of m-nitrobenzoic acid, component (d), utilized as component (iv) in Coating Solution (A) in Example 1.

The results which were obtained on testing these light-sensitive materials under the same conditions as those described in Example 1 are set forth in Table 5 below. The solvent used for component (iv) in each instance was ethanol.

TABLE 5

| Sample No. | Component (iv) | Prior to Forced Deterioration Fog | $D_{max}$ | Relative Sensitivity | After Forced Deterioration Fog | $D_{mas}$ | Relative Sensitivity |
|---|---|---|---|---|---|---|---|
| (K) | Phthalic Acid 0.5% 2cc | 0.08 | 1.18 | 88 | 0.09 | 1.06 | 45 |
| (L) | Tetrachloro-phthalic Acid Anhydride 0.95% 2cc | 0.08 | 1.14 | 78 | 0.09 | 0.95 | 40 |
| (A) | m-Nitrobenzoic Acid 0.5% 2cc | 0.08 | 1.39 | 100 | 0.09 | 1.38 | 85 |

When the processed Light-Sensitive Materials (K) and (L) were each exposed to room light of about 300 lux for 15 minutes, the background thereof was colored pink, whereas the background of Light-Sensitive Material (A) did not change.

These facts demonstrate that m-nitrobenzoic acid is superior in terms of photographic properties to phthalic acid and tetrachlorophthalic acid anhydride.

EXAMPLES 3 TO 5

Thermally Developable Light-Sensitive Materials (M), (N) and (O) were prepared in the same manner as in Example 1, except for the following. That is, p-bromobenzoic acid, 3,4-dichlorobenzoic acid and 4-chloro-3-nitrobenzoic acid were each substituted for the m-nitrobenzoic acid (iv) employed in Coating Solution (A) as described in Table 1.

The results which were obtained on testing these light-sensitive materials under the same conditions as in Example 1 are shown in Table 6 below. In addition, the results which were obtained in light discoloration testing are shown in Table 7 below. The solvent used for component (iv) in each instance was ethanol.

TABLE 6

| Sample No. | Component (iv) | Prior to Forced Deterioration Fog | $D_{max}$ | Relative Sensitivity | After Forced Deterioration Fog | $D_{max}$ | Relative Sensitivity |
|---|---|---|---|---|---|---|---|
| (M) | p-Bromobenzoic Acid 0.6% 2cc | 0.10 | 1.38 | 103 | 0.13 | 1.38 | 95 |
| (N) | 3,4-Dichloro-benzoic Acid 0.6% 2cc | 0.08 | 1.38 | 100 | 0.09 | 1.36 | 83 |
| (O) | 4-Chloro-3-nitrobenzoic Acid 0.6% 1cc | 0.07 | 1.36 | 95 | 0.08 | 1.35 | 80 |
| (B) | — | 0.10 | 1.36 | 100 | 0.23 | 1.35 | 55 |

TABLE 7

| Sample No. | Light Discoloration* |
|---|---|
| (M) | 0.12 |
| (N) | 0.12 |
| (O) | 0.14 |
| (B) | 0.15 |

*The light discoloration was evaluated by the difference between the background density after the samples had been passed through the COPYSTER and the background density prior to the passage.

The results in Tables 6 and 7 above demonstrate that p-bromobenzoic acid, 3,4-dichlorobenzoic acid and 4-chloro-nitrobenzoic acid, as component (d) of the present invention, decreased the thermal fog on the sample both prior to and after the forced deterioration.

In addition, these benzoic acids improved the light discoloration.

Still further, from the fact that the light discoloration of the sample wherein m-nitrobenzoic acid or 3,4-dichlorobenzoic acid was used was smaller than that of the sample wherein 4-chloro-3-nitrobenzoic acid was used, a compound having an HNP of [$HNP_{BA}$+95 mV] or less is particularly preferred.

COMPARATIVE EXAMPLE 3

Thermally Developable Light-Sensitive Materials (P), (Q), (R), (S) and (T) were prepared in the same manner as in Example 1, except for the following. That is, p-tert-butylbenzoic acid, p-anisic acid and 3,4-dinitrobenzoic acid were each substituted for the m-nitrobenzoic acid (iv) utilized in Coating Solution (A) as described in Example 1.

The results which were obtained on testing these light-sensitive materials under the same conditions as those utilized in Example 1 are given in Table 8 below. The solvent used for component (iv) in each instance was ethanol.

TABLE 8

| Sample No. | Component (iv) | Prior to Forced Deterioration Fog | $D_{max}$ | Relative Sensitivity | After Forced Deterioration Fog | $D_{max}$ | Relative Sensitivity |
|---|---|---|---|---|---|---|---|
| (P) | p-tert-Butyl-benzoic Acid 0.6% 2cc | 0.11 | 1.35 | 100 | 0.24 | 1.33 | 57 |
| (Q) | p-tert-Butyl-benzoic Acid 0.6% 4cc | 0.12 | 1.35 | 93 | 0.23 | 1.33 | 53 |
| (R) | p-Anisic Acid 0.5% 2cc | 0.10 | 1.34 | 100 | 0.24 | 1.32 | 50 |
| (S) | p-Anisic Acid 0.5% 4cc | 0.11 | 1.35 | 95 | 0.24 | 1.33 | 48 |
| (T) | 3,4-Dinitro-benzoic Acid 0.6% 1cc | 0.08 | 0.95 | 65 | 0.09 | 0.65 | 35 |
| (B) | — | 0.10 | 1.36 | 100 | 0.23 | 1.35 | 55 |

As is apparent from the results in Table 8 above, benzoic acids having too low a half-neutralization point hardly decrease the thermal fog.

On the other hand, benzoic acids having too high a half-neutralization point decrease the $D_{max}$ and intensively desensitize the material.

COMPARATIVE EXAMPLE 4

A mixture of 100 ml of an aqueous solution having 1.9 g of sodium hydroxide dissolved therein and 200 ml of toluene with 12 g of lauric acid dissolved therein was emulsified with a homogenizer (mixer). To the emulsified solution was added 50 ml of an aqueous solution having 8.5 g of silver nitrate dissolved therein to prepare silver laurate.

After removing the aqueous phase from the reaction mixture, the residual toluene phase which contained the silver laurate was dispersed into 180 g of a 15 weight% isopropanol solution of polyvinyl butyral with a homogenizer. 16 ml of an acetone solution containing 1.1 weight% of N-bromoacetamide was added to 80 g of the thus-obtained polymer dispersion containing about 1/60 mol of a silver salt and then the mixture was heated at 50° C. for 60 minutes.

One fourth of this polymer dispersion was weighed out. (This corresponds to about 1/240 mol of the silver salt.) To this maintained at 20° C. and with stirring were added successively the following components at 5 minute intervals to prepare a coating solution.

| | |
|---|---|
| (i) Merocyanine Dye * (sensitizing dye) (0.025 weight % methyl Cellosolve solution) | 2 ml |
| (ii) Sodium Benzenethiosulfonate (0.02 weight % methanol solution) | 2 ml |
| (iii) Phthaladinone (4.5 weight % methyl Cellosolve) | 5 ml |
| (iv) m-Nitrobenzoic Acid (0.5 weight % ethanol solution) | x ml |
| (v) p-Bisphenol ** (reducing agent) | |

-continued

| | |
|---|---|
| (10 weight % acetone solution) | 13 ml |

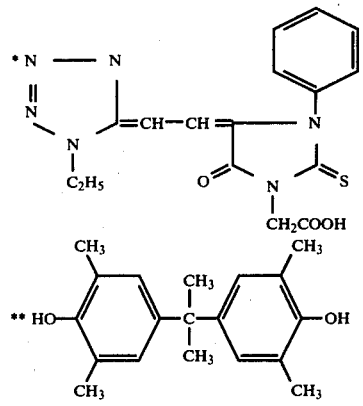

Thermally Developable Light-Sensitive Materials (U), (V), (W) and (X) were each prepared by coating the thus-obtained coating solutions in the same manner as in Example 1, respectively.

The results which were obtained by subjecting these light-sensitive materials to sensitometry under the same conditions as those utilized in Example 1 are given in Table 9 below.

TABLE 9

| Sample No. | Amount of Component (iv) Added (ml) | Fog | $D_{max}$ |
|---|---|---|---|
| (U) | 0 | 0.15 | 1.35 |
| (V) | 0.2 | 0.15 | 1.12 |
| (W) | 0.5 | 0.12 | 0.90 |
| (X) | 1 | 0.10 | 0.34 |

The results in Table 9 above demonstrate that where silver laurate was primarily utilized as an organic silver salt, even m-nitrobenzoic acid had a reduced $D_{max}$, which was disadvantageous.

While the invention has been described in detail and with reference to specific embodiments thereof, it will be apparent to one skilled in the art that various changes and modifications can be made therein without departing from the spirit and scope thereof.

What is claimed is:

1. In a thermally developable light-sensitive material which comprises a support having therein or in one or more layers thereon at least (a) an organic carboxylic acid silver salt comprising about 50 mol% or more silver behenate, (b) a photocatalyst, and (c) a reducing agent, the improvement which comprises (d) at least one compound (1) represented by the following general formula (I):

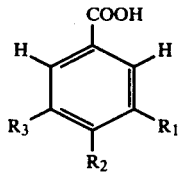

(I)

wherein $R_1$, $R_2$ and $R_3$, which may be the same or different, each represents a hydrogen atom or a substituent selected from the group consisting of a nitro group, a cyano group and a halogen atom, with the proviso that $R_1$, $R_2$ and $R_3$ are not all simultaneously a hydrogen atom; and (2) additionally having a half-neutralization point of from about 40 mV to about 140 mV above the half-neutralization point of benzoic acid in isopropanol; being present in the support or in at least one layer on the support.

2. The material of claim 1, wherein the material further contains (e) at least one thiosulfonic acid compound represented by the general formula (II):

$$RSO_2SM_1$$

wherein R represents an aliphatic group or an aryl group, and $M_1$ represents a cation other than a hydrogen ion.

3. The material of claim 2, wherein R in the general formula (II) represents an alkyl group having 22 or less carbon atoms; an alkyl group substituted with an alkoxy group having 1 to 8 carbon atoms or an aryl group having 6 to 18 carbon atoms; an aryl group having 6 to 30 carbon atoms; or an aryl group substituted with an alkyl group having 1 to 8 carbon atoms, an alkaryl group having 7 to 14 carbon atoms or an aryl group having 6 to 18 carbon atoms.

4. The material of claim 2, wherein the thiosulfonic acid compound is sodium n-octylthiosulfonate, potassium n-dodecylthiosulfonate, potassium n-dodecanethiosulfonate, sodium benzylthiosulfonate, sodium n-undecanethiosulfonate, potassium n-tetradecanethiosulfonate, lithium benzylthiosulfonate, potassium n-hexadecanethiosulfonate, potassium 2-ethoxyethylthiosulfonate, sodium benzenethiosulfonate, lithium benzenethiosulfonate, potassium benzenethiosulfonate, potassium p-toluenethiosulfonate, sodium p-toluenethiosulfonate, potassium p-methoxybenzenethiosulfonate, potassium p-ethoxybenzenethiosulfonate, sodium 2-naphthylthiosulfonate, potassium 3-t-butylbenzenethiosulfonate, sodium 3,4-dimethylbenzenethiosulfonate, potassium 3-chlorobenzenethiosulfonate, sodium 4-nitrobenzenethiosulfonate or potassium 3-acetylbenzenethiosulfonate.

5. The material of claim 2, wherein the thiosulfonic acid compound is present in an amount of from $10^{-5}$ mol to 1 mol per mol of the organic carboxylic acid silver salt component (a).

6. The material of claim 1, wherein the compound represented by the general formula (I) has a half-neutralization point of from 40 mV to 95 mV above that of benzoic acid in isopropanol.

7. The material of claim 1, wherein the compound represented by the general formula (I) is m-nitrobenzoic acid, p-nitrobenzoic acid, m-cyanobenzoic acid, m-bromobenzoic acid, p-bromobenzoic acid, 4-chloro-3-nitrobenzoic acid, 3,4-dichlorobenzoic acid, 3,5-dichlorobenzoic acid, m-chlorobenzoic acid, p-chlorobenzoic acid, m-fluorobenzoic acid or p-fluorobenzoic acid.

8. The material of claim 7, wherein the compound represented by the general formula (I) is m-nitrobenzoic acid, m-cyanobenzoic acid, m-bromobenzoic acid, p-bromobenzoic acid, 3,4-dichlorobenzoic acid, 3,5-dichlorobenzoic acid, m-chlorobenzoic acid, p-chlorobenzoic acid, m-fluorobenzoic acid or p-fluorobenzoic acid.

9. The material of claim 1, wherein the compound represented by the general formula (I) is present in a light-sensitive layer thereof.

10. The material of claim 1, wherein the compound represented by the general formula (I) is present in an amount of from about 0.0005 mol to about 0.3 mol per mol of the organic carboxylic acid silver salt component (a).

11. The material of claim 1, wherein said component (a) comprises an organic carboxylic acid silver salt containing at least 70 mol% of silver behenate.

* * * * *